US006029449A

United States Patent [19]

Heikrodt et al.

[11] Patent Number: 6,029,449

[45] Date of Patent: Feb. 29, 2000

[54] HEAT AND COLD-GENERATING MACHINE

[75] Inventors: Klaus Heikrodt, Krefeld; Bernd Thomas, Reutlingen, both of Germany

[73] Assignee: Robert Bosch GmbH, Stuttgart, Germany

[21] Appl. No.: 08/860,211

[22] PCT Filed: Jan. 13, 1996

[86] PCT No.: PCT/EP96/00134

§ 371 Date: Jul. 24, 1997

§ 102(e) Date: Jul. 24, 1997

[87] PCT Pub. No.: WO96/23182

PCT Pub. Date: Aug. 1, 1998

[30] Foreign Application Priority Data

Jan. 25, 1995 [DE] Germany ..... 195 02 190

[51] Int. Cl.[7] ..... F01B 29/10

[52] U.S. Cl. ..... 60/525; 60/526

[58] Field of Search ..... 60/517, 525, 526

[56] References Cited

U.S. PATENT DOCUMENTS 3,688,512 9/1972 Prast et al. .

5,400,599 3/1995 Sekiya et al. .

FOREIGN PATENT DOCUMENTS 3536710 4/1987 European Pat. Off. .

0611927 8/1994 European Pat. Off. .

2156773 5/1973 Germany .

*Primary Examiner*—Hoang Nguyen

*Attorney, Agent, or Firm*—Venable; George Spencer; Norman Kunitz

[57] ABSTRACT

A hot and cold engine operating based on a regenerative gas cyclical process, with at least two pistons (2, 3), which separate at least three processing chambers (4, 6, 7) with an in-line arrangement of respectively at least one heat exchanger (13, 15) and at least one regenerator (11, 12) arranged in series with the heat exchanger. In order to eliminate the danger of freezing for the cold heat exchanger (15) and thus the air heat exchanger (16), at least one of the regenerators (12) assigned to the cold processing chamber (6) has a bypass (17) with a control valve (17*a*).

4 Claims, 2 Drawing Sheets

HEAT AND COLD-GENERATING MACHINE

BACKGROUND OF THE INVENTION

The invention concerns a hot and cold engine, operating based on a regenerative gas cyclical process, and having at least two pistons that separate at least three processing chambers with respectively at least one in-line arranged heat exchanger and at least one regenerator arranged in series with the heat exchanger.

Hot and cold engines that operate based on a regenerative gas cyclical process, for example based on the Stirling or Vuilleumier cyclical process, have been known for a long time, e.g. from the GP-PS 136 195. Such engines have two pistons that move linearly inside a pressure-sealed housing and jointly delimit a warm working volume. One of these pistons delimits a hot working volume admitted with heat inside the housing and the other piston delimits a cold working volume, wherein the three working volumes are connected to each other, with an in-line arrangement of regenerators and heat exchangers, and wherein a drive and/or a control for the pistons is provided.

Despite the undisputable advantages of the hot and cold engines operating based on a regenerative gas cyclical process, these engines have not been used in practical operations so far, primarily because of design problems, which have so far prevented the realization of the theoretical advantages of such engines in practical operations.

With hot and cold engines operating based on a regenerative gas cyclical process, which are used for the heating and cooling of buildings and vehicles and are provided with a heat exchanger functioning as heat source that is admitted by environmental air, there is the danger that the air heat exchanger freezes at air temperatures around the freezing point and high humidity levels. In that case, the cold heat exchanger of the engine also freezes because of the continued engine operation. This danger of freezing exists even if interruptions occur in the cold cycle of the engine, e.g. if the circulating pump fails.

In order to eliminate this danger, it is known to thaw out the air heat exchanger or to heat it before it freezes. This requires expensive heating devices, which are not only very undesirable, but also require extensive controls that normally also result in a shutting down of the complete engine.

It is the object of the invention to create a hot and cold engine operating based on a regenerative gas cyclical process, for which the freezing danger for the cold heat exchanger is removed in an energy-efficient way with simple design means and simple regulation technology.

SUMMARY OF THE INVENTION

The solution for the above object is achieved in that at least one of the regenerators assigned to the cold processing chamber is provided with at least one bypass with a control valve, in order to change the amount of heat transferred via the cold heat exchanger cycle between process gas and surrounding area.

As a result of the inventive design having a bypass leading to at least one of the regenerators assigned to the cold heat exchanger, the bypass valve is opened for limited time periods if icing occurs at the air heat exchanger, so that no heat is drawn from the process gas in the regenerator circumvented by the bypass and the cold heat exchanger arranged in the engine is in this way raised to a temperature above the freezing point by the heat coming from the warm processing chamber, which simultaneously de-ices the air heat exchanger. In this way, a freezing of the cold heat exchanger is avoided with continued engine operation, even if the circulating pump in the cycle belonging to the cold heat exchanger fails.

For one preferred embodiment of the invention, the bypass line is designed in the shape of a through opening in the regenerator, which is closed off on both ends during the normal engine operation. This results in a regenerator design without dead space.

In accordance with another feature of the invention, the bypass line is closed off by a plunger, which can be moved by an electromagnet counter to the force of a pull-back spring. This modification according to the invention results in an especially simple and functionally secure design with low space requirement.

An optionally configured embodiment of the invention is shown in the drawing in addition to a diagram of the exemplary embodiment of a hot and cold engine operating based on a regenerative gas cyclical process.

DETAILED DESCRIPTION OF THE PREFERRED EMBODIMENT

Figure 1:
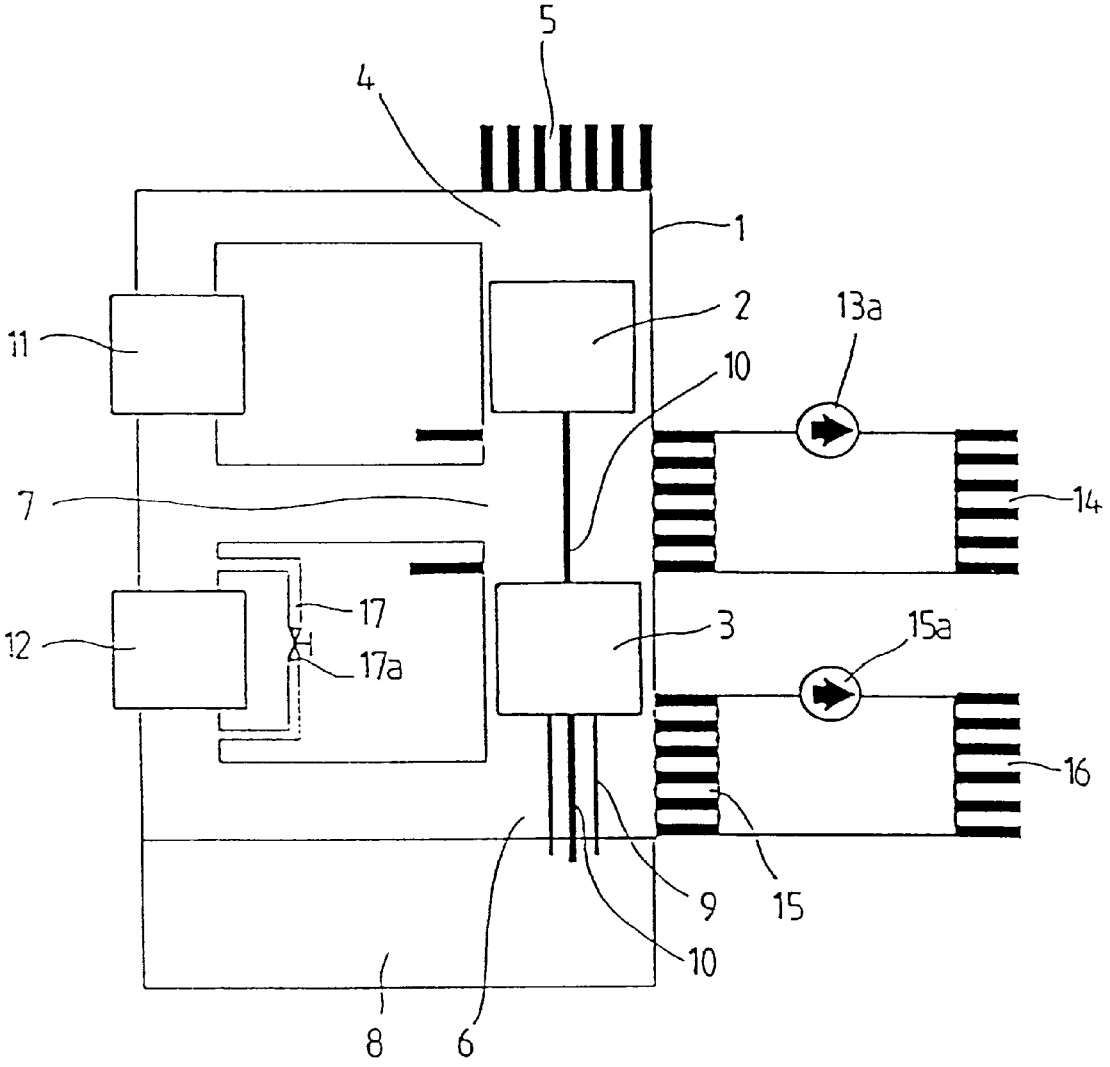
FIG. 1 is a diagrammatic representation of a hot and cold engine.

The hot and cold engine shown as a diagram in FIG. 1 comprises a pressure-sealed housing 1, inside of which a hot piston 2 and a cold piston 3 are arranged such that they move in a linear direction. The hot piston 2 limits a hot working volume 4 that is supplied with heat, e.g., from a gas-heated combustion chamber 5. The cold piston 3 limits a cold working volume 6. Both pistons 2 and 3 limit a warm working volume 7. For this embodiment, a gear 8 is provided to synchronize the movement of pistons 2 and 3, which gear is connected via a hollow piston rod 9 to the cold piston 3 and via another piston rod 10 to the hot piston 2.

One regenerator 11 or 12 respectively is arranged between the hot working volume 4 and the warm working volume 7 as well as between the warm working volume 7 and the cold working volume 6. The warm working volume 7 is furthermore coordinated with a warm heat exchanger 14, which is arranged in series with the regenerator 11 and through which process gas flows the same way as through the regenerator. From this warm heat exchanger 13, heat is supplied in the closed cycle via a circulating pump 13*a* to a heat exchanger, which is configured, for example, as heater 14.

The cold working volume 6 also has a cold heat exchanger 15 assigned to it, through which process gas flows, which is connected in series with the regenerator 12 and is arranged together with an air heat exchanger 16 in a closed cycle. This cycle also has a circulating pump 15*a*.

In the diagram of an embodiment of a hot and cold engine, shown in FIG. 1, the regenerator 12 assigned to the cold working volume 6 has a bypass 17, with therein arranged bypass valve 17*a*. This bypass valve 17*a* is closed during normal operations, so that the bypass 17 does not affect the hot and cold engine operating based on a regenerative gas cyclical process.

Since the air heat exchanger 17 draws heat from the atmospheric air, there is the danger that this air heat exchanger 16 freezes at air temperatures around the freezing point and with high humidity. With continued engine operation, the heat exchanger 15 would in that case also freeze. Not only would this impede the gas cyclical process, but it would cause the temperature in the cold working volume 7 to drop so drastically as to bring on the danger of destruction of the engine. This danger exists even if the heat exchange in the cold heat exchanger 15 is impeded, e.g., as a result of a malfunction in the circulating pump 15*a*.

In order to remove this freezing danger of the air heat exchanger 16 and thus the cold heat exchanger 15 not only at air temperatures around the freezing point, but also in case of a malfunction of the circulating pump 15*a,* the bypass valve 17*a* is opened, at least for limited time periods. As a result of the lower flow resistance, the process gas will flow through the bypass 17, thereby circumventing the regenerator 12, so that no heat is drawn from the process gas in the regenerator 12. Since the cold heat exchanger 15 is arranged in line with the regenerator 12, the cold heat exchanger 15 is held or raised to a temperature above the freezing point by the heat coming from the warm working volume 7.

As a result of this, the air heat exchanger 16 is thawed out in case of icing or is protected against freezing, provided the circulating pump 15*a* is operational. If the circulating pump 15*a* fails, which simultaneously prevents an undercooling of the air heat exchanger 16, the heat coming from the warm working volume 7 ensures that even though the engine continues to operate despite the circulating pump 15*a* failure, the cold heat exchanger 15 is not undercooled, which would lead to a destruction of the engine.

Figure 2:
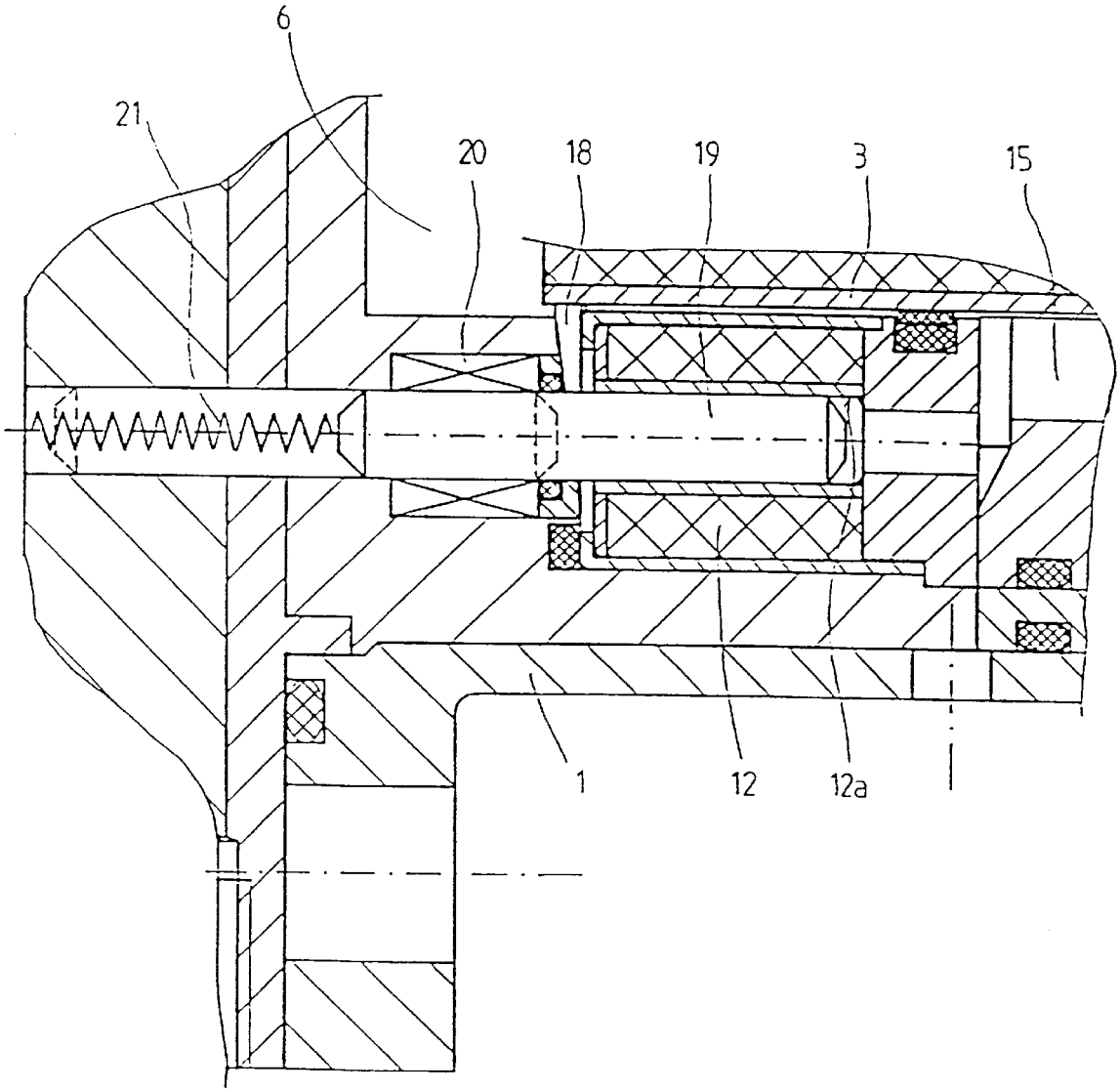
FIG. 2 is a longitudinal section through an embodiment of a regenerator provided with a bypass.

FIG. 2 shows an embodiment of the regenerator 12 as a longitudinal section.

A section of the housing 1 and the cold piston 3 of the engine can be seen in the drawing. The regenerator 12 is connected via a ring channel 18 with the cold working volume 6 of the engine and is arranged in line with the cold heat exchanger 15, a section of which is also shown in FIG. 2. The section of regenerator 12 that is shown in FIG. 2 is also provided with a through opening 12*a* that can be closed off with a plunger 19. In the closed position, the plunger 19 fills the through opening 12*a* in regenerator 12, which functions as bypass, so that the bypass does not result in a dead space during the normal engine operation.

The plunger 19, which together with the through opening 12*a* forms the bypass valve, can be moved by an electromagnet 20 counter to the force of a return spring 21 from the closed position shown in FIG. 2. This release position and thus the opening of the bypass is shown in FIG. 2 with dashed line. In this dashed-line position, the process gas flows through the through opening 12*a* by essentially bypassing the regenerator 12, in order to prevent in this way a freezing of the cold heat exchanger 15 and thus the air heat exchanger 16, which is not shown in FIG. 2.

Reference List:

1 housing 20 electromagnet
2 hot piston 21 return spring
3 cold piston
4 hot working volume
5 combustion chamber
6 cold working volume
7 warm working volume
8 gears
9 hollow piston rod
10 piston rod
11 regenerator
12 regenerator
12*a* through opening
13 warm heat exchanger
13*a* circulating pump
14 heater
15 cold heat exchanger
15*a* circulating pump
16 air heat exchanger
17 bypass
17*a* bypass valve
18 ring channel
19 plunger

We claim:

1. Hot and cold engine operating based on a regenerative gas cyclical process, with said engine having at least two pistons (2, 3) that separate at least three processing chambers (4, 6, 7) with respectively at least one in-line arranged heat exchanger (13, 15) and at least one regenerator (11, 12) arranged in series with the heat exchanger; and at least one of the regenerators (12) assigned to the cold processing chamber (6) has a bypass (17) with at least one control valve (17*a*) for changing the amount of heat transferred via the cold heat exchanger cycle between process gas and surrounding air.

2. Hot and cold engine according to claim 1, wherein the bypass line (17) is designed as a through opening (12*a*) in the regenerator (12), which is closed off on both ends during the normal engine operation.

3. Hot and cold engine according to claim 1, wherein the bypass line (17) can be closed off with a plunger (19), which can be moved via an electromagnet (20), counter to the force of a return spring (21).

4. Hot and cold engine according to claim 2, wherein the bypass line (17) can be closed off with a plunger (19), which can be moved via an electromagnet (20), counter to the force of a return spring (21).

* * * * *